US009242813B2

(12) United States Patent
Abe et al.

(10) Patent No.: US 9,242,813 B2
(45) Date of Patent: Jan. 26, 2016

(54) IMAGE FORMING APPARATUS, AND INSERTION CONTAINER

(71) Applicant: FUJI XEROX CO., LTD., Tokyo (JP)

(72) Inventors: Takashi Abe, Kanagawa (JP); Shouichi Maeda, Kanagawa (JP); Takuya Mori, Kanagawa (JP); Yusuke Itozaki, Kanagawa (JP); Yoshinori Shuin, Kanagawa (JP); Tomohiro Yokoyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/526,998

(22) Filed: Oct. 29, 2014

(65) Prior Publication Data

US 2015/0224798 A1 Aug. 13, 2015

(30) Foreign Application Priority Data

Feb. 10, 2014 (JP) ..... 2014-023225

(51) Int. Cl.

| | |
|---|---|
| ***B41J 2/01*** | (2006.01) |
| ***B65H 3/02*** | (2006.01) |
| ***B41J 2/10*** | (2006.01) |
| ***B41J 13/10*** | (2006.01) |
| ***B41J 13/16*** | (2006.01) |

(52) U.S. Cl.

CPC ... *B65H 3/02* (2013.01); *B41J 2/10* (2013.01); *B41J 13/10* (2013.01); *B41J 13/16* (2013.01)

(58) Field of Classification Search

CPC ..... B41J 13/10; B41J 13/16; B41J 13/20; B41J 13/06; B41J 11/58; B41J 11/103; B41J 11/106

See application file for complete search history.

(56) References Cited

U.S. PATENT DOCUMENTS

| | | | | |
|---|---|---|---|---|
| 4,662,765 | A * | 5/1987 | Kapp | B41J 13/10 271/186 |
| 2002/0164190 | A1* | 11/2002 | Hill | B41J 13/103 400/624 |
| 2009/0194935 | A1 | 8/2009 | Wakakusa et al. | |
| 2010/0124449 | A1 | 5/2010 | Asada et al. | |
| 2012/0313310 | A1* | 12/2012 | Kunioka | B41J 13/106 271/3.14 |

FOREIGN PATENT DOCUMENTS

JP 2009-179455 A 8/2009

* cited by examiner

*Primary Examiner* — Juanita D Jackson
(74) *Attorney, Agent, or Firm* — Oliff PLC

(57) ABSTRACT

Provided is an image forming apparatus including a main body that is provided with an insertion hole, and forms an image on a recording medium, and an insertion container in which the recording medium is stored, and that is inserted into the insertion hole, wherein the insertion container includes a first part, a second part that extends rearward in a direction of the insertion from the first part, and that is movable forward and backward in the insertion direction with respect to the first part, a fastening tool that fastens the second part to the first part, a releasing tool that releases the fastening tool when grasped, and that moves forward and backward with the second part, and a protruding tool that protrudes from the second part to the main body when the releasing tool is grasped, and that prevents the second part from being inserted into the insertion hole.

5 Claims, 9 Drawing Sheets

IMAGE FORMING APPARATUS, AND INSERTION CONTAINER

CROSS-REFERENCE TO RELATED APPLICATIONS

This application is based on and claims priority under 35 USC 119 from Japanese Patent Application No. 2014-023225 filed Feb. 10, 2014.

BACKGROUND

Technical Field

The present invention relates to an image forming apparatus, and an insertion container.

SUMMARY

According to an aspect of the invention, there is provided an image forming apparatus including:

a main body that is provided with an insertion hole, and forms an image on a recording medium; and an insertion container in which the recording medium is stored, and that is inserted into the insertion hole, wherein the insertion container includes:

a first part, a second part that extends rearward in a direction of the insertion from the first part, and that is movable forward and backward in the insertion direction with respect to the first part, a fastening tool that fastens the second part to the first part, a releasing tool that releases the fastening tool when grasped, and that moves forward and backward with the second part, and a protruding tool that protrudes from the second part to the main body when the releasing tool is grasped, and that prevents the second part from being inserted into the insertion hole.

BRIEF DESCRIPTION OF THE DRAWINGS

Exemplary embodiments of the present invention will be described in detail based on the following figures, wherein.

DETAILED DESCRIPTION

Hereinafter, an exemplary embodiment of the invention will be described with reference to drawings.

Figure 1:
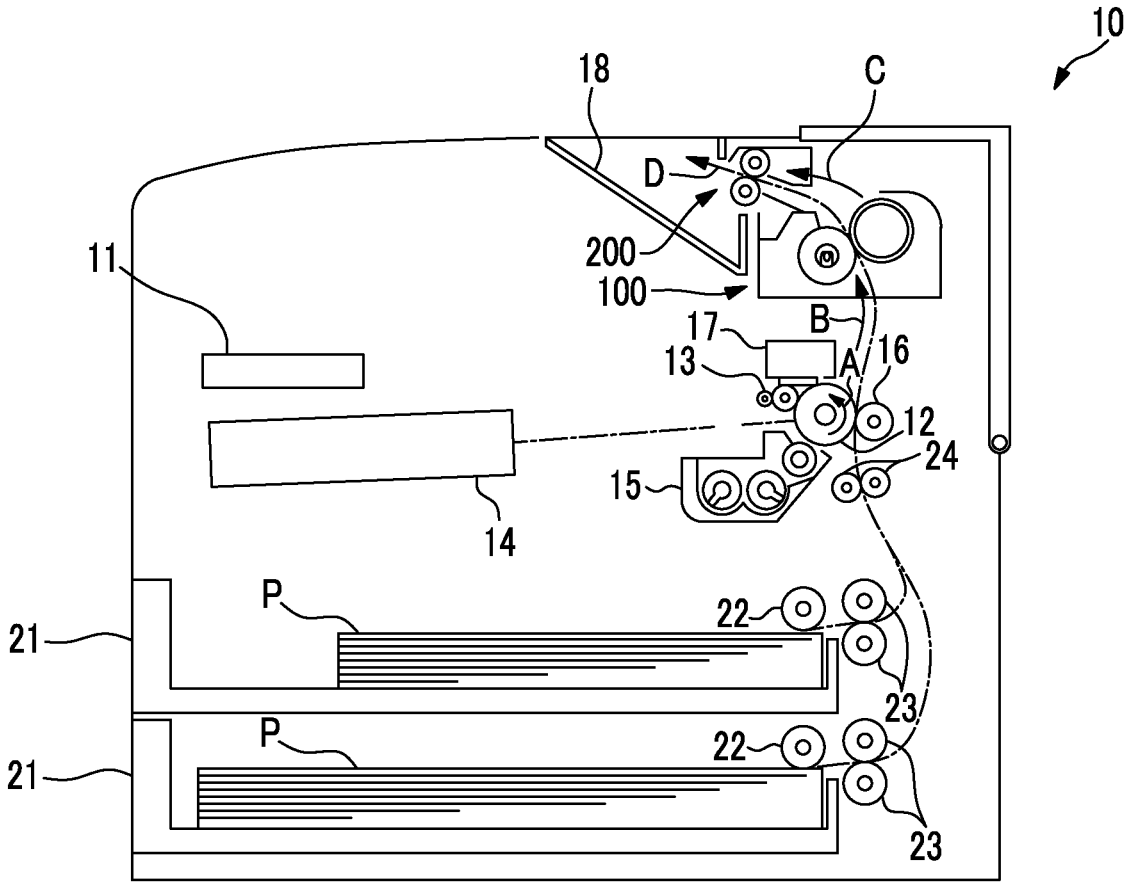
FIG. 1 is a schematic configuration diagram of a printer that corresponds to an exemplary embodiment of an image forming apparatus according to the invention.

FIG. 1 is a schematic configuration diagram of a printer that corresponds to an exemplary embodiment of an image forming apparatus according to the invention.

A printer 10 illustrated in FIG. 1 is a monochrome printer. An exemplary embodiment of an insertion container according to the invention is incorporated into the printer 10.

An image signal that is produced out of the printer 10 and represents an image is input into the printer 10 via a signal cable (not illustrated) or the like. A control unit 11, which controls movements of respective configuration components in the printer 10, is provided in the printer 10, and the image signal is input into the control unit 11. In the printer 10, image formation is performed based on the image signal with the control unit 11 in control.

Two sheet trays 21 are accommodated in a lower portion of the printer 10. Sheets P that have different dimensions from each other are accommodated, in a stacked state, in the respective sheet trays 21. Each of the sheet trays 21 is drawable from a front surface side of the printer 10, which is the left side in FIG. 1, so as to replenish the sheets P. The sheet trays 21 correspond to the exemplary embodiment of the insertion container according to the invention, and the printer 10 illustrated in FIG. 1 from which the sheet trays are removed corresponds to an example of a main body according to the exemplary embodiment of the invention. In addition, the sheets P correspond to an example of a recording medium according to the exemplary embodiment of the invention. Not only the sheets P but also OHP sheets, plastic paper, and the like may also be adopted as the recording medium according to the exemplary embodiment of the invention.

The sheets P with a dimension that suits the dimension of the image which is represented by the image signal input into the control unit 11 are fed from one of the two sheet trays 21 by a pickup roller 22. The sheets P that are fed are separated sheet by sheet by a retard roll 23, and the separated sheet P is transported upward so that a lead edge of the sheet P reaches a registration roller 24. The registration roller 24 adjusts subsequent transport timing to serve to feed the sheet P. The sheet P that reaches the registration roller 24 continues to be transported with the subsequent transport timing adjusted by the registration roller 24.

A photoconductor 12, which rotates in a direction shown by an arrow A, is provided above the registration roller 24 in the printer 10. A charging unit 13, an exposure unit 14, a developing unit 15, a transfer unit 16, and a photoconductor cleaner 17 are arranged around the photoconductor 12.

The photoconductor 12 has a cylindrical shape. The charging unit 13 charges a surface of the photoconductor 12 by applying charges to the surface of the photoconductor 12.

The exposure unit 14 allows laser light (exposure light) that is modulated according to the image signal which is supplied from the control unit 11 to be output. An electrostatic latent image is formed on the surface of the photoconductor 12 due to exposure by the exposure light.

The electrostatic latent image that is formed on the surface of the photoconductor 12 is developed by the developing unit 15 so that a toner image is formed.

Herein, the registration roller 24 feeds the sheet P at a timing when the toner image on the photoconductor 12 reaches a position facing the transfer unit 16 so that the sheet P reaches the position at that timing. Then, the toner image on the photoconductor 12 is transferred, by an effect of the transfer unit 16, onto the sheet P which is fed.

The toner that remains on the photoconductor 12 after the transfer of the toner image is removed from the photoconductor 12 by the photoconductor cleaner 17.

The sheet P to which the toner image is transferred continues to move in an arrow B direction, and the toner image is fixed onto the sheet P due to heating and pressurization by a fixing unit 100. As a result, an image formed of the fixed toner image is formed on the sheet P.

The sheet P that passes the fixing unit 100 moves in an arrow C direction toward a discharge unit 200. Moreover, the sheet P continues to be fed in an arrow D direction by the discharge unit 200 to be discharged onto a discharge table 18.

Figure 2:
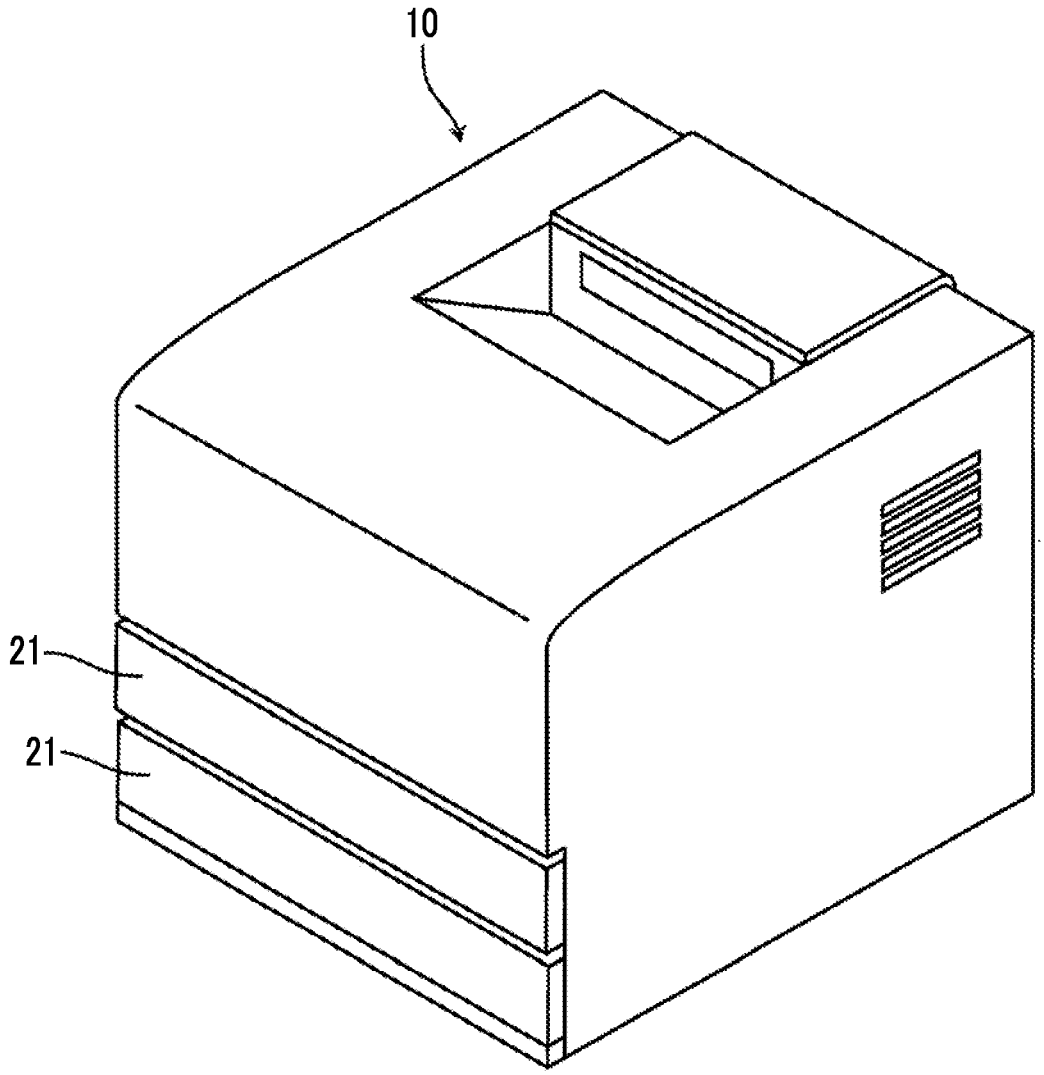
FIG. 2 is a perspective view illustrating an appearance of the printer.

FIG. 2 is a perspective view illustrating an appearance of the printer.

FIG. 2 illustrates the appearance of the front surface side of the printer 10 illustrated in FIG. 1. The sheet trays 21 described above are inserted from the front surface side into the printer 10. In addition, the gap between the sheet trays 21 and the gap between the sheet trays 21 and the whole housing of the printer 10 are narrow for aesthetic reasons, reduction in size, and the like.

As described above, the sheet trays 21 are drawable to the front surface side of the printer 10 from the state illustrated in FIG. 2.

Figure 3:
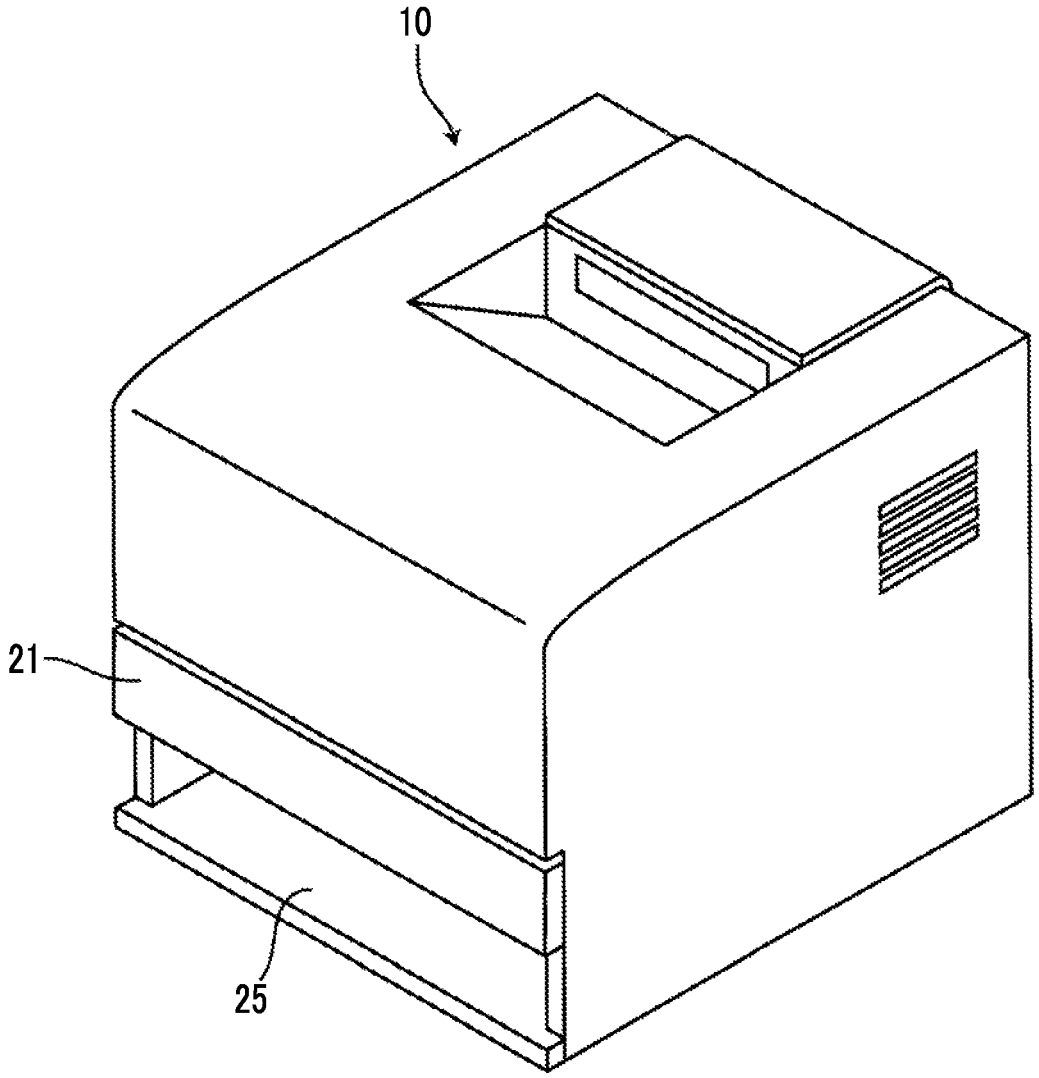
FIG. 3 is a perspective view illustrating the printer in a state where a sheet tray is withdrawn.

FIG. 3 is a perspective view illustrating the printer in a state where the sheet trays are withdrawn.

Insertion ports 25 are disposed in the printer 10, and the sheet trays 21 are mounted on the printer 10 by being inserted into the insertion ports 25. The insertion ports 25 correspond to an example of an insertion hole according to the exemplary embodiment of the invention.

Figure 4:
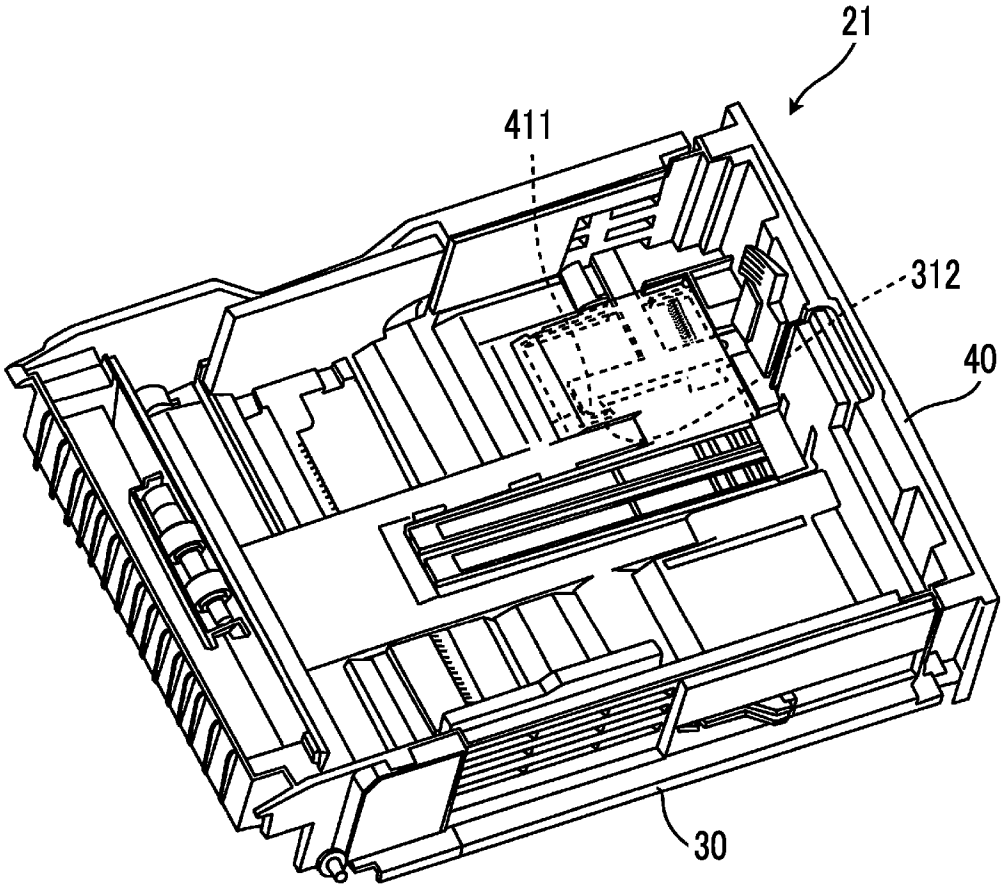
FIG. 4 is a perspective view illustrating the sheet tray.

FIG. 4 is a perspective view illustrating the sheet tray.

The left side in FIG. 4 corresponds to a far side of the printer 10, and the right side in FIG. 4 corresponds to the front surface side of the printer 10.

The sheet tray 21 has a tray main body 30 that is inserted into the far side of the printer 10, and an extending portion 40 that is fitted into the tray main body 30 to be positioned on the front surface side of the printer 10 with respect to the tray main body 30 (that is, to be positioned on a rear side in a direction in which the sheet tray 21 is inserted into the printer 10). The sheet tray 21 is extended and contracted in overall length when the extending portion 40 moves forward and backward with respect to the tray main body 30. The tray main body 30 corresponds to an example of a first part according to the exemplary embodiment of the invention, and the extending portion 40 corresponds to an example of a second part according to the exemplary embodiment of the invention.

The state that is illustrated in FIG. 4 is a contracted state where the sheet tray 21 is short in overall length. In this state, the sheet tray 21 is accommodated in the printer 10 as illustrated in FIG. 1.

However, in the state that is illustrated in FIG. 4 and in a case corresponding to a large sheet which is not stored in the sheet tray 21, the sheet tray 21 is extended in overall length and apart of the sheet tray 21 protrudes from the printer 10 while the printer 10 is used.

A lock mechanism (described in detail later) is incorporated into the sheet tray 21 so that the extending portion 40 is extended and contracted with respect to the tray main body 30 when necessary and is fixed to the tray main body 30 when unnecessary. With the lock mechanism, the overall length of the sheet tray 21 is fixed in both the contracted state and the extended state.

Hereinafter, a structure of the sheet tray 21, mainly the lock mechanism, will be further described.

Figure 5:
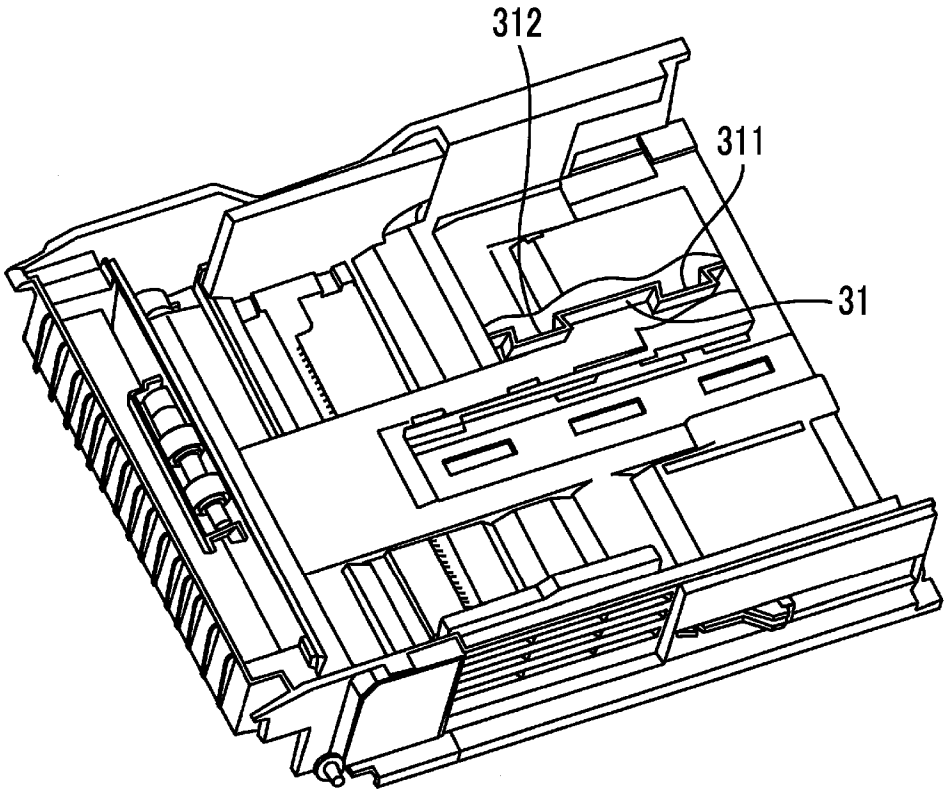
FIG. 5 is a perspective view illustrating a tray main body.
Figure 6:
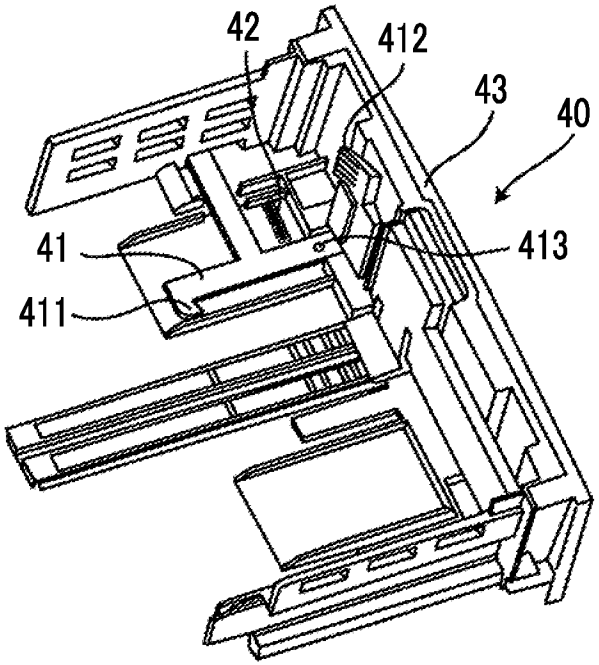
FIG. 6 is a perspective view illustrating an extending portion.

FIG. 5 is a perspective view illustrating the tray main body, and FIG. 6 is a perspective view illustrating the extending portion.

FIG. 5 illustrates a state where a part of the tray main body 30 is cut out, and a rib 31 that protrudes to a bottom side of the tray main body 30 is disposed in the tray main body 30. Two hook portions 311 and 312 are formed in the rib 31.

A lock arm 41 is disposed in the extending portion 40, and a lock end portion 411 of the lock arm 41 is hooked on any one of the hook portions 311 and 312 of the rib 31 so that the extending portion 40 is in a lock state where the extending portion 40 is fixed to the tray main body 30. The lock end portion 411 corresponds to an example of a fastening tool according to the exemplary embodiment of the invention, and the lock arm 41 corresponds to an example of an integral member according to the exemplary embodiment of the invention.

The extending portion 40 is also provided with a press spring 42, and the press spring 42 presses the lock arm 41 to the rib 31 side so that the lock state of the sheet tray 21 is maintained. In addition, a release knob 412 is disposed in the lock arm 41. When the release knob 412 is grasped with a front wall 43 of the extending portion 40 by a user, the lock arm 41 rotates against the press spring 42 about a fulcrum 413. As a result, the lock end portion 411 is separated from the hook portions 311 and 312 of the rib 31, and the sheet tray 21 is in a release state. In the release state, the extending portion 40 may move forward and backward with respect to the tray main body 30. A direction in which the extending portion 40 moves forward and backward in this case is along the direction in which the sheet tray 21 is inserted into the printer 10.

Figure 7:
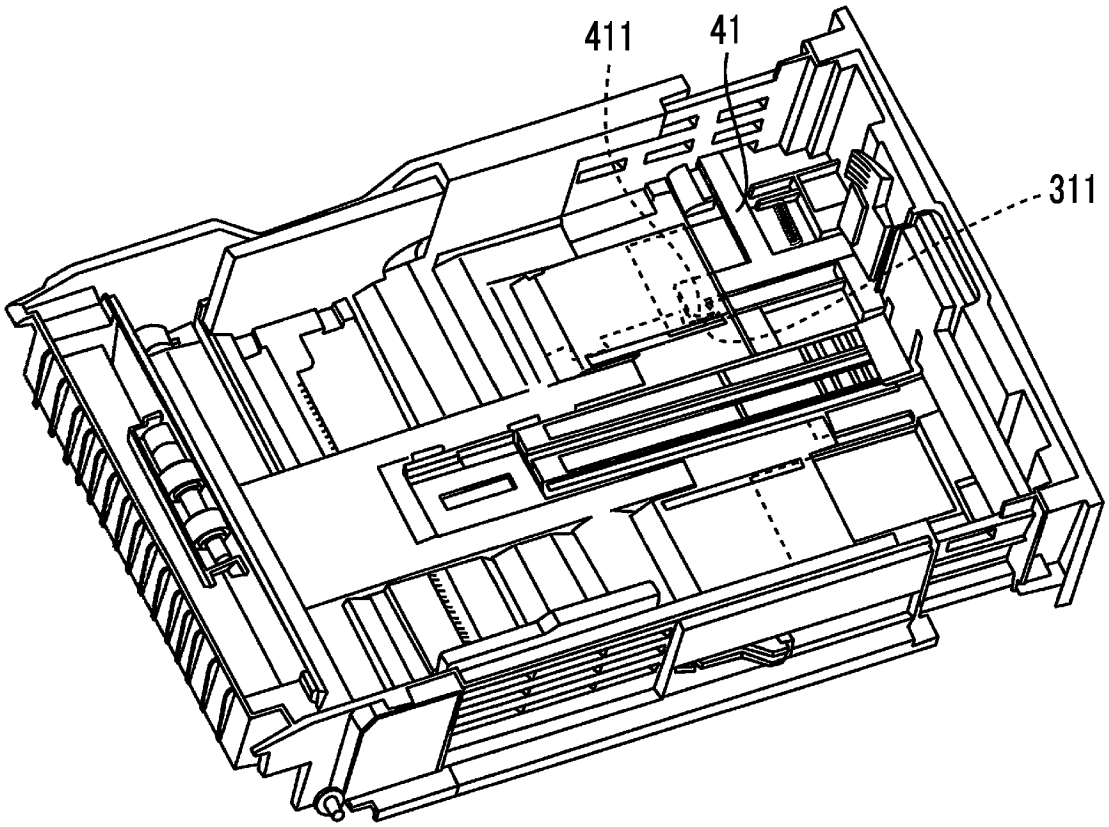
FIG. 7 is a view illustrating a state where the sheet tray is extended in overall length.

FIG. 7 is a view illustrating a state where the sheet tray is extended in overall length.

As illustrated in FIG. 7, the lock end portion 411 of the lock arm 41 is hooked on the hook portion 311 that is positioned on the front surface side of the printer 10 in the state where the sheet tray 21 is extended in overall length. In contrast, the lock end portion 411 is hooked on the hook portion 312 that is positioned on the far side of the printer 10 in the state illustrated in FIG. 4 where the sheet tray 21 is contracted in overall length.

The lock state and the release state of the sheet tray 21 will be further described focusing on an operation of the lock arm 41.

Figure 8:
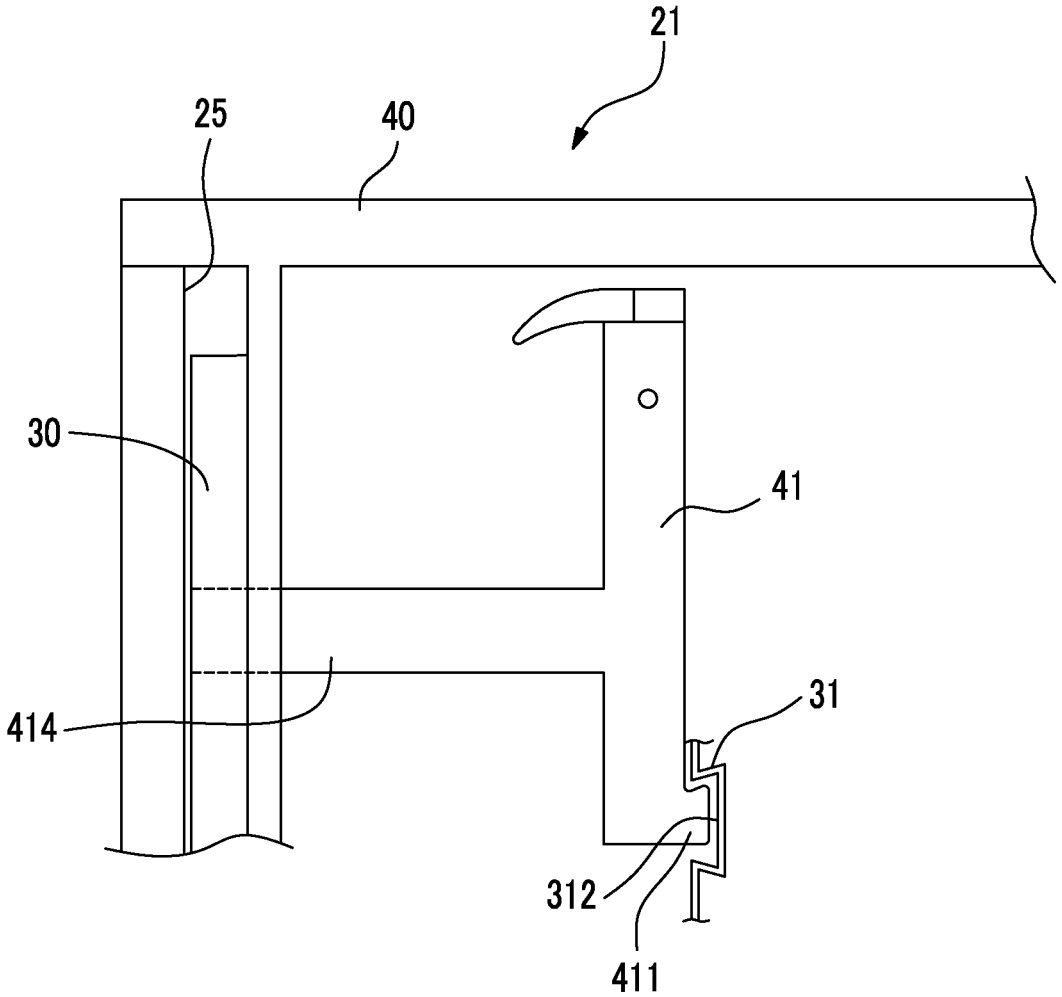
FIG. 8 is a view illustrating a lock arm in a lock state in detail.

FIG. 8 is a view illustrating the lock arm in the lock state in detail.

As an example of the lock state, FIG. 8 illustrates the lock state where the extending portion 40 is pushed to the tray main body 30 side for the sheet tray 21 to be contracted in overall length (refer to FIG. 4).

When the sheet tray 21 is in the lock state, the lock end portion 411 of the lock arm 41 is hooked on the hook portion 312 of the rib 31 as described above. In addition, a protruding portion 414 extends from the middle of the lock arm 41, and a tip end of the protruding portion 414 penetrates a side wall of the extending portion 40 to reach a side wall of the tray main body 30. The tip end of the protruding portion 414 does not protrude from an outer surface of the side wall of the tray main body 30, and thus the tray main body 30 and the extending portion 40 are inserted into the insertion port 25 without being interfered by the protruding portion 414.

In the lock state where the sheet tray 21 is extended in overall length (refer to FIG. 5), a part of the rear side of the extending portion 40 in the insertion direction is stopped while protruding from the insertion port 25.

Figure 9:
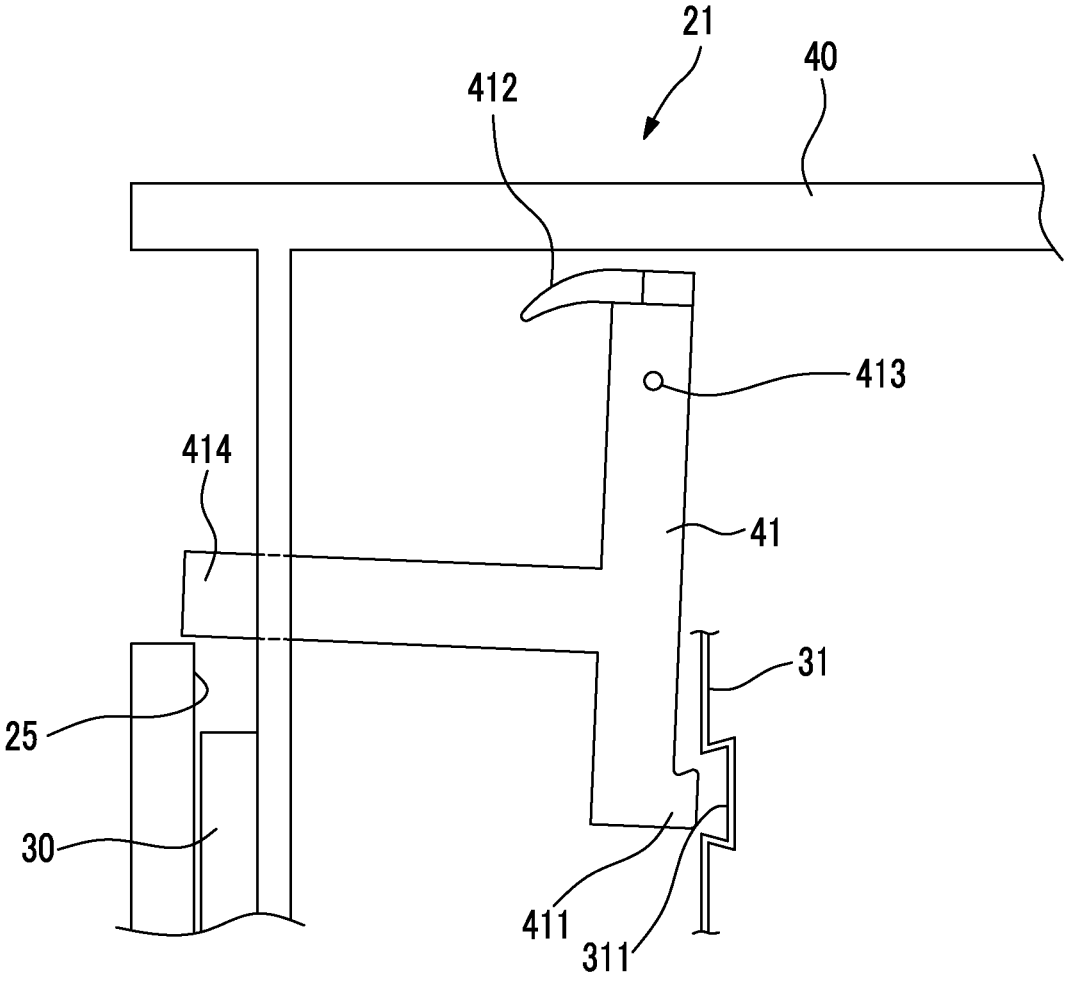
FIG. 9 is a view illustrating the lock arm in a release state in detail.

FIG. 9 is a view illustrating the lock arm in the release state in detail.

As an example of an open state, FIG. 9 illustrates the release state where the extending portion 40 is drawn out of the tray main body 30 and the sheet tray 21 is extended in overall length (refer to FIG. 5).

When the release knob 412 of the lock arm 41 is grasped, the lock arm 41 rotates about the fulcrum 413 and the lock end portion 411 is separated from the hook portion 311 of the rib 31 as described above. The tip end of the protruding portion 414 protrudes outside from the outer surface of the side wall of the tray main body 30 in response to the rotation of the lock arm 41. As a result, the tip end of the protruding portion 414 interferes with an inlet port of the insertion port 25, and a movement of the extending portion 40 into the insertion port 25 is blocked. Since the lock end portion 411 of the lock arm 41 is separated from the hook portion 311, the extending portion 40 moves into the tray main body 30 side when the user who grasps the release knob 412 presses the extending portion 40 with the release knob 412 grasped. However, since the movement of the extending portion 40 into the insertion port 25 is blocked by the protruding portion 414, a situation in which the hand grasping the release knob 412 touches the printer 10 as a whole may be avoided, which results in high safety.

In a case where the sheet tray 21 is contracted in overall length, the sheet tray 21 is withdrawn from the insertion port 25, the release knob 412 is grasped, and the extending portion 40 is pushed to the tray main body 30 side. Then, the release knob 412 may be separated and the sheet tray 21 may be in the lock state for insertion into the insertion port 25 as illustrated in FIG. 8.

The description of the exemplary embodiment is completed here.

The monochrome printer has been suggested as an example of the image forming apparatus in the description above. However, the image forming apparatus according to the exemplary embodiment of the invention may also be applied to copiers, facsimiles, and multifunction machines, and may also be applied to color printers. In addition, the image forming apparatus according to the exemplary embodiment of the invention may also be an apparatus adopting an ink jet method as well as an apparatus adopting an electrophotographic method.

In addition, the lock arm in which the fastening tool, the releasing tool, and the protruding tool according to the exemplary embodiment of the invention are integrated with each other has been suggested as an example in the description above. However, the fastening tool, the releasing tool, and the protruding tool according to the exemplary embodiment of the invention do not necessarily have to be integrated, and may be separate parts interlocking with each other.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a main body that is provided with an insertion hole, and forms an image on a recording medium; and an insertion container in which the recording medium is stored, and that is inserted into the insertion hole, wherein the insertion container includes:

a first part;

a second part that extends rearward in a direction of the insertion from the first part, and that is movable forward and backward in the insertion direction with respect to the first part;

a fastening tool that fastens the second part to the first part;

a releasing tool that releases the fastening tool when grasped, and that moves forward and backward with the second part; and a protruding tool that protrudes from the second part to the main body when the releasing tool is grasped, and that prevents the second part from being inserted into the insertion hole.

2. The image forming apparatus according to claim 1, further comprising:

an integral member that is obtained by integrally connecting the fastening tool, the releasing tool, and the protruding tool, and in which a place of the fastening tool is released and a place of the protruding tool protrudes when a place of the releasing tool is grasped to result in an integral movement.

3. The image forming apparatus according to claim 1 that is applied to any one of copies, facsimiles, multifunction machines, and color printers.

4. The image forming apparatus according to claim 1 that adopts an ink jet method, or an electrophotographic method.

5. An insertion container comprising:

a first part that is inserted into an insertion hole;

a second part that extends rearward in a direction of the insertion from the first part, and that is movable forward and backward in the insertion direction with respect to the first part;

a fastening tool that fastens the second part to the first part;

a releasing tool that releases the fastening tool when grasped, and that moves forward and backward with the second part; and a protruding tool that protrudes from the second part to the main body when the releasing tool is grasped, and that prevents the second part from being inserted into the insertion hole.

* * * * *